US005197403A

United States Patent [19]

Hatlapa

[11] Patent Number: 5,197,403

[45] Date of Patent: Mar. 30, 1993

[54] SAILING VESSEL AND PROFILE MAST FOR SAILING VESSELS

[76] Inventor: Rolf Hatlapa, Theodor-Storm Allee 24 b, 2082 Uetersen, Fed. Rep. of Germany

[21] Appl. No.: 733,723

[22] Filed: Jul. 19, 1991

[51] Int. Cl.[5] ..... B63B 15/00

[52] U.S. Cl. ..... 114/90; 114/102

[58] Field of Search ..... 114/39.1, 90, 102–107, 114/112

[56] References Cited

U.S. PATENT DOCUMENTS

| | | | |
|---|---|---|---|
| 3,866,558 | 2/1975 | Bergstrom et al. | 114/90 |
| 4,149,482 | 4/1979 | Hoyt | 114/106 |
| 4,267,790 | 5/1981 | Hood | 114/106 |
| 4,269,134 | 5/1981 | Shapland | 114/107 |
| 4,487,148 | 12/1984 | Umelda | 114/106 |

FOREIGN PATENT DOCUMENTS 3120472 7/1988 Fed. Rep. of Germany .

*Primary Examiner*—Jesüs D. Sotelo
*Attorney, Agent, or Firm*—Thomas N. Ljungman

[57] ABSTRACT

Sailing vessel and mast for sailing vessels wherein the mast is in the form of a profile body. In an arrangement with a profile mast to hold a reefing roller, the mast is braced with its mast foot between the deck and keel area of the vessel. The profile body is thereby configured as a rigid beam with spars in the forward area; while the rear area, a receptacle chamber, is formed by wall parts with elastic areas; and a slot opening for the emergence of the sail is bordered by terminal strips, which can be elastically pressed against one another.

11 Claims, 5 Drawing Sheets

SAILING VESSEL AND PROFILE MAST FOR SAILING VESSELS

BACKGROUND OF THE INVENTION

1. Field of the Invention

This invention relates to a sailing vessel and a profile mast for sailing vessels. The profile mast is mounted and braced so that it can rotate, with the foot of the mast between the deck and the keel area of the vessel. In the rear mast area, there is a receptacle for the reefing shaft of a roller reefing device on which the sail guided through a slot on the rear edge of the profile mast can be rolled up. Generally, a profile mast is a mast with an aerodynamic profile. That is, the mast body has a forward curved nose and aerodynamic sides which extend rearward from the nose and converge to form the slot on the rear edge of the profile mast.

2. Background Information

Such a profile mast is disclosed in U.S. Pat. No. 4,149,482. In that patent, the mast is set at an angle corresponding to prevailing conditions. In practice, however, problems exist in the aerodynamically favorable lee-side configuration of the transition area between the profile mast and the sail in the vicinity of the emergence slot. That is, relatively large airflow separations occur in this transitional area.

An additional profile mast of the same general type is disclosed in Federal Republic of Germany Patent No. 31 20 472, whereby the mast is adjusted by means of a complex mechanical apparatus.

OBJECT OF THE INVENTION

The object of the invention is therefore to improve a profile mast of the type described above and to create a mast configuration with an adjustable emergence area for the sail, which adjustable emergence area guarantees an aerodynamically favorable transition between the profile mast and the sail.

SUMMARY OF THE INVENTION

This object is achieved by means of a profile mast of the present invention; wherein, the sail, which is furled on a roller reefing device located within the mast, emerges-from the mast through a slot. The end strips bordering the slot for the emergence of the sail are elastically mounted and can be pressed against one another. As a result of these elastic areas of the walls of the receptacle chamber for the reefing roller, an adjustable transition area is created from the profile mast to the sail so that there is no separation of the flow.

A favorable configuration is created if the end strips bordering the sail emergence slot are designed with a raised profile on the side facing the sail.

For the adjustment of the mast, the invention proposes that in the forward area of the profile mast, there are arresting stays engaged with the profile lug, which arresting stays run from the profile lug toward both sides of the vessle; the arresting stays permit the rotation of the profile mast. In one favorable configuration, the arresting stays on both sides are adjustably coupled by means of a drive apparatus for the rotational movement.

In a simple design of this mast, the profile mast is formed by stiffened shells made of carbon fiber reinforced plastic (CFK), which stiffened shells are rigidly connected by spars in the forward area, and the elastic areas of the wall parts in the rear area of the profile mast are formed by reducing the wall thickness of the stiffened shells.

So that the profile mast does not represent any hazard for the vessel in a strong wind, the profile mast has a receptacle in the upper area of the mast for the fastening of a large-volume cable. The large-volume cable is for the spiral winding as a flow separator. That is, the cable can be wound around the profile mast to prevent unfurling of the sail. Alternatively, the cable can wind the sail itself around the mast.

A further feature of the invention resides broadly in a sailing vessel having a hull with a keel and a deck; a profile mast rotatably mounted on said hull; said profile mast comprising a mast body having aerodynamic sides, said aero dynamic sides forming an aerodynamic forward portion and said aerodynamic sides extending rearward from said forward portion, said aerodynamic sides having end strips at the rear edges, and said aerodynamic sides convering towards each other rearward to form a slot at the rear of said profile mast; means for retracting and paying out a sail through said slot; means within said mast body for receiving said means for retracting and paying out a sail through said slot; a sail disposed on said means for retracting and paying out a sail through said slot; a boom disposed on said profile mast for supporting said sail; and said aerodynamic sides of said mast body having elastic wall parts being configured to press said end strips towards one another for providing an aerodynamically favorable transition area between said profile mast and said sail.

Yet another feature of the invention resides in a profile mast for being rotatably mounted on a sailing vessel, the profile mast comprising a mast body having aerodynamic sides, said aerodynamic sides forming an aerodynamic forward portion and said aerodynamic sides extending rearward from said forward portion, said aerodynamic sides having end strips at the rear edges, and said aerodynamic sides converging towards each other rearward to form a slot at the rear of the profile mast; means for accepting means for rotating said mast body; means for retracting and paying out a sail through said slot; means within said mast body for receiving said means for retracting and paying out a sail through said slot; and said aerodynamic sides of said mast body having elastic wall parts being configured to press said end strips towards one another for providing an aerodynamically favorable transition area between the profile mast and a sail.

BRIEF DESCRIPTION OF THE DRAWINGS

One embodiment of the invention is schematically illustrated in the accompanying drawings.

DESCRIPTION OF THE PREFERRED EMBODIMENTS

Figure 1:
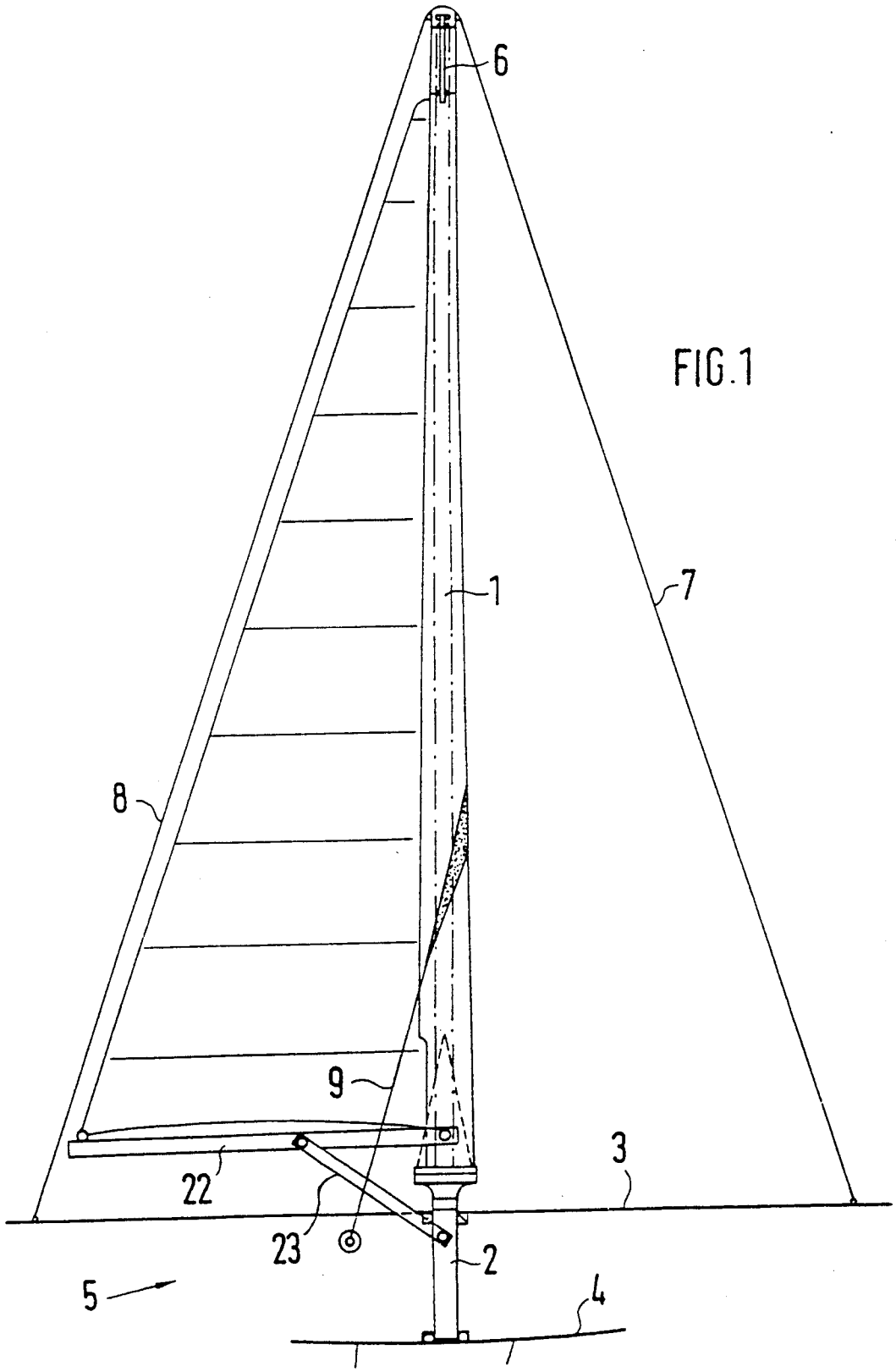
FIG. 1 shows a side view of the profile mast.
Figure 1A:
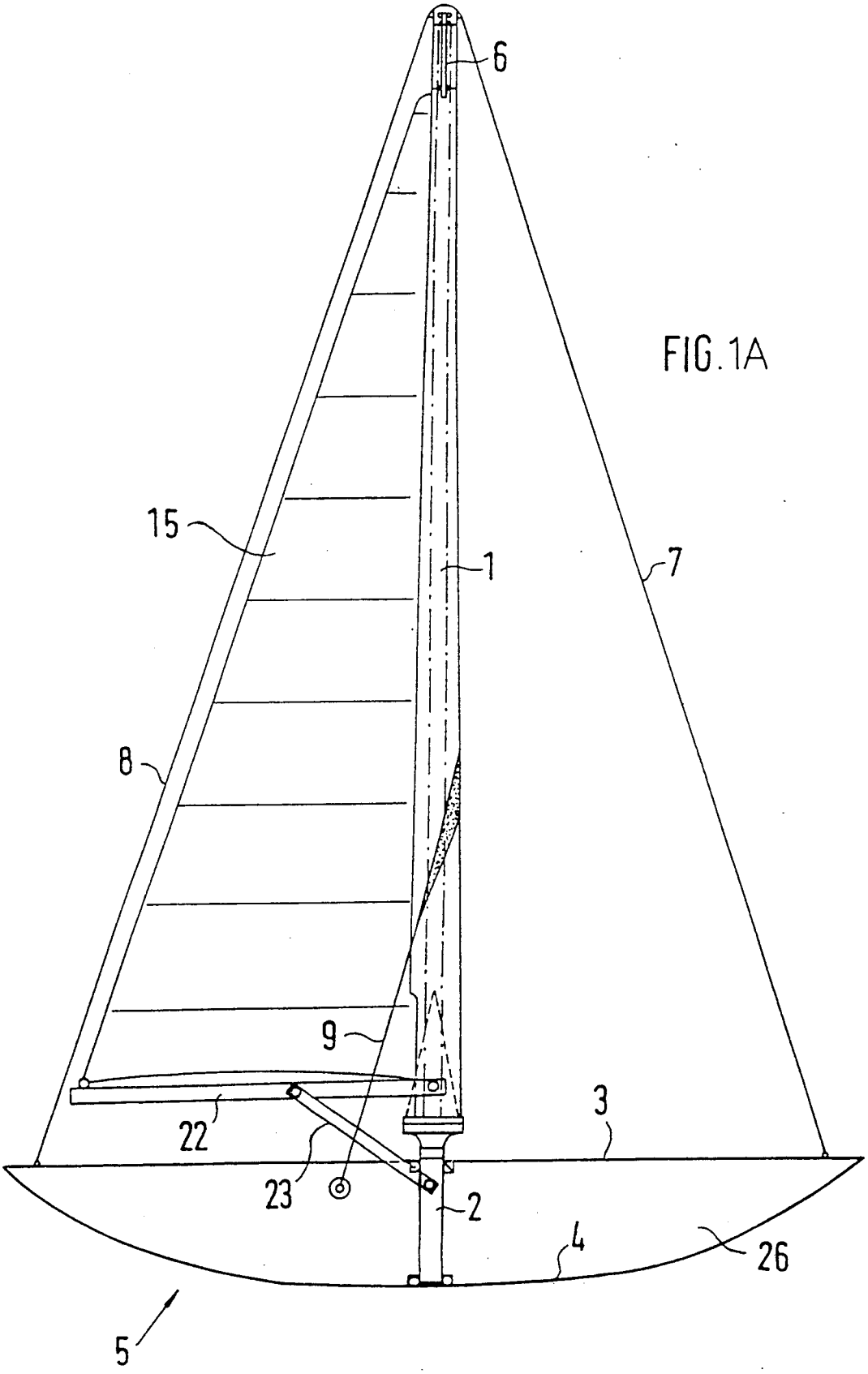
FIG. 1A shows a side view of the sailing vessel with the profile mast.
Figure 2:
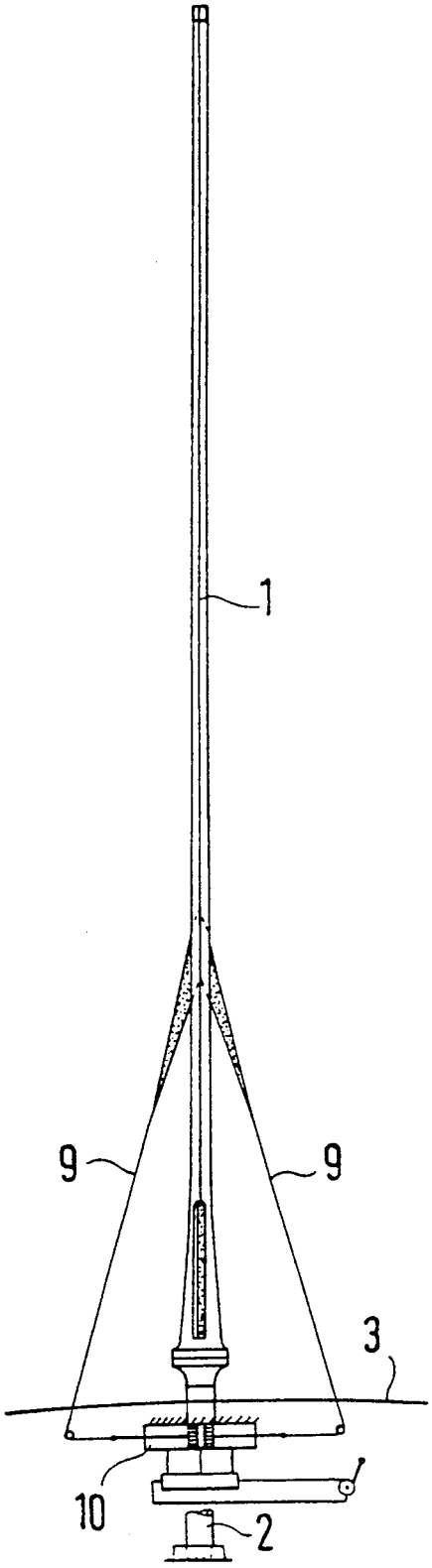
FIG. 2 shows a rear view of the profile mast with a corresponding cylinder arrangement for rotating the mast by means of arresting stays.

The profile mast 1 shown in FIGS. 1A, 1, and 2 is braced so that it can rotate with its mast foot 2. The mast foot 2 is between the deck are 3 and keel area 4 of the sailing vessel 5. The sailing vessel 5 has a hull 26. The profile mast 1 is supported by means of a rotatable top bearing 6 with a fore stay 7 and an aft stay 8. The rotation of the profile mast 1 is performed by means of arresting stays 9 which are engaged with the profile lug (profile nose) and run toward both sides of the vessel 5. The fastening of the arresting stays 9 to the profile lug, the front part of the mast 1, is made approximately below one-half the mast height. The two arresting stays 9 are coupled by means of a drive apparatus 10, which can be appropriately activated for the rotation and bracing of the profile mast 1. The drive apparatus 10 may be a cylinder arrangement (as shown in FIG. 2) or a hand crank, which drive apparatus 10 puts tension on one of the arresting stays 9 and releases tension on the other of the arresting stays 9, thus rotating the profile mast. The cylinder arrangement is operated by pumping fluid from on side of a cylinder to the other, which moves an intervening piston.

Figure 3:
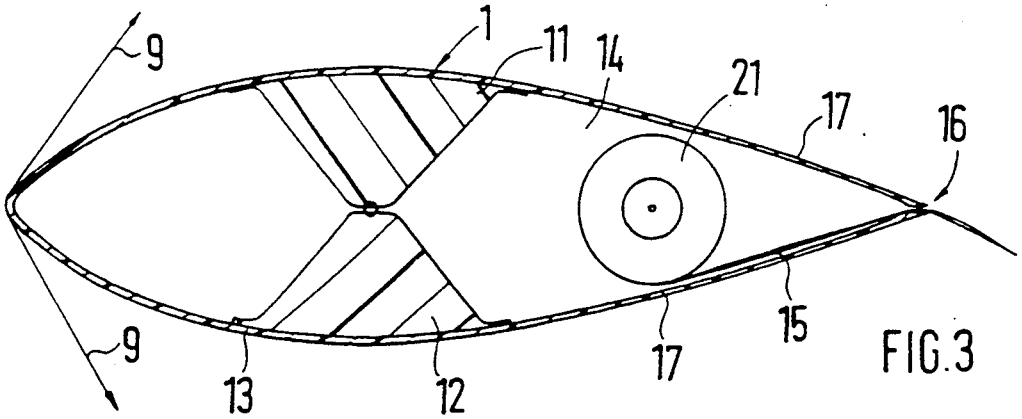
FIG. 3 shows a cross section through the profile mast.

As shown in FIG. 3, the profile mast 1 is formed by aerodynamic sides or stiffened shells 25, which are reinforced by spars 11, 12, for the formation of a rigid beam in a forward area 13. The aerodynamic sides or stiffened shells 25 meet to form a forward profile nose and curve rearward to form slot 16. In the rear area of the profile mast 1, a receptacle chamber 14 is formed for the reefing shaft 21 of a reefing roller apparatus, which holds the sail 15. In addition, the sail 15 is held by means of a boom 22 located on the profile mast 1 in a manner well known in the prior art. As shown in FIG. 1, the boom 22 is held by means of a boom repeater 23, so that it can rotate with the profile mast 1.

Figure 4:
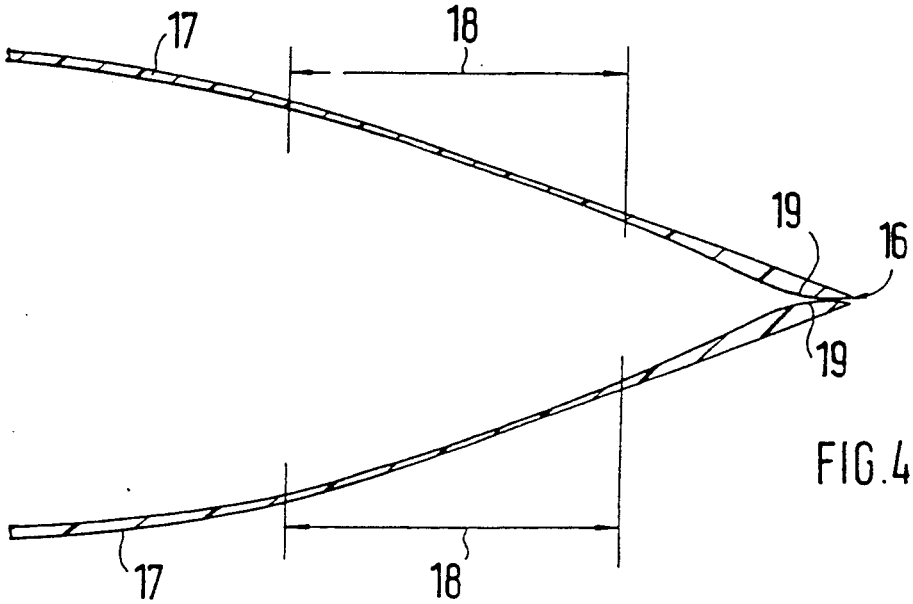
FIG. 4 shows an enlarged view of a partial cross section through the rear portion of the profile mast with the slot for the emergence of the sail and with end strips as raised profile elements.

As shown in FIG. 4, the stiffened shells 25 have the wall parts 17; the wall parts 17 are located opposite one another in the area of the rear edge of the profile mast 1. The wall parts 17 have a reduced wall thickness for the formation of elastic areas 18. The terminal areas of the stiffened shells 25 adjacent to the slot 16 are designed as rigid terminal strips or end strips 19, which on the side facing the sail 15 have raised profiles. The raised profiles of rigid terminal strips 19 can be elastically pressed against one another by the elastic areas 18 of the wall parts 17.

During sailing, the profile mast 1 is placed in the desired position by means of the arresting stays 9 and the drive apparatus 10 designed as a cylinder arrangement, as seen in FIG. 2. As shown in FIGS. 3 and 4, the terminal strips 19 are set against the intervening sail 15 (not shown in FIG. 4) as a result of the elastic areas 18 of the wall parts 17. Thus, there is always an aerodynamically favorable adjustment of the transition region between the profile mast 1 and the sail 15, so that a separation of the airflow is prevented. That is, the elastic areas 18 are biased to press the terminal strips 19 against the sail 15 located in the slot 16 formed by the terminal strips 19.

Figure 5:
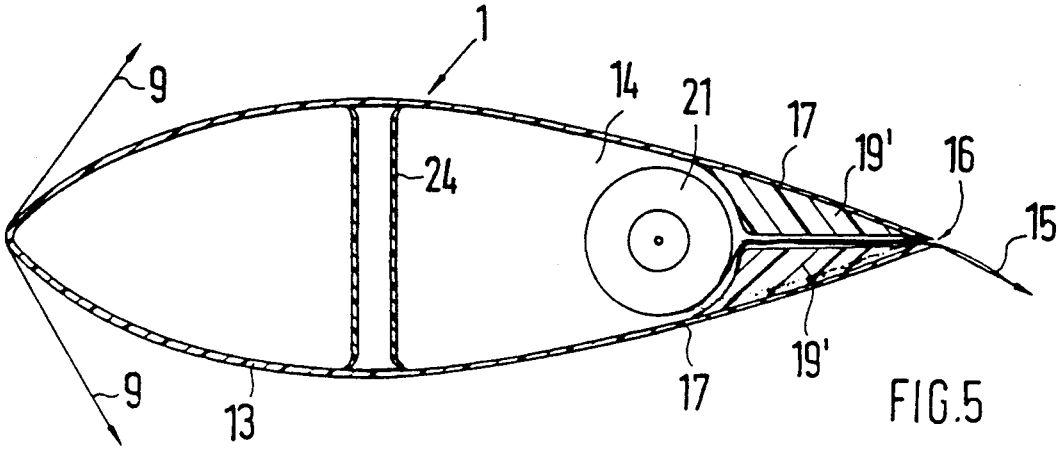
FIG. 5 shows an alternative illustration to FIG. 3, with end strips as beads and a web in the forward area.
Figure 6:
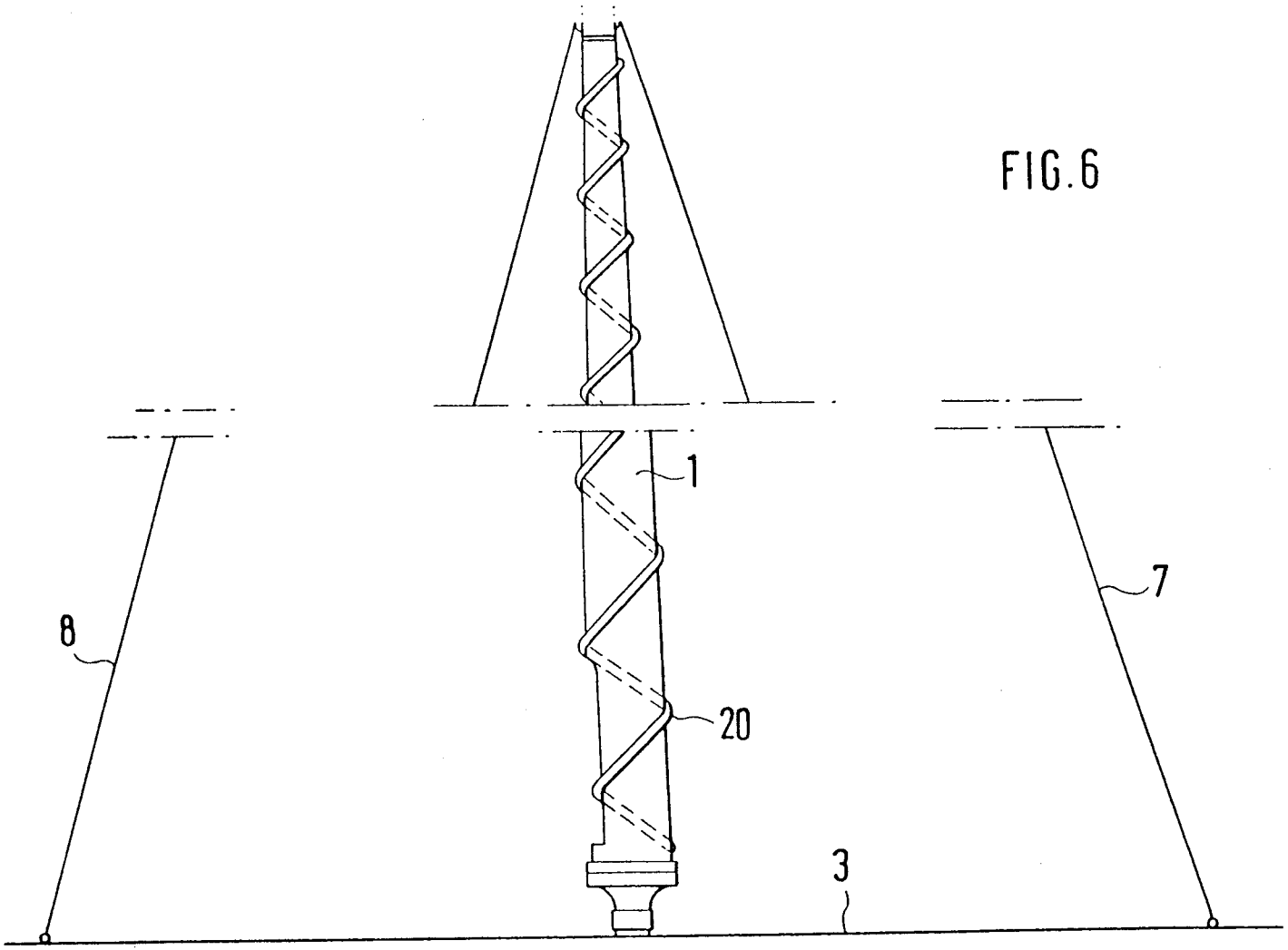
FIG. 6 shows the profile mast with a wound cable for flow separation.

FIG. 5 shows an alternative in which, to form a rigid beam, the stiffened shells 25 are connected to one another in the forward area 13 of the profile mast 1 by a web 24. There are also enlarged terminal strips in the form of beads 19' which, as adjacent terminal areas, form the slot 16. These bilateral beads 19, are continuous to the vicinity of the reefing shaft 21, and the bilateral beads 19' support the sail 15 as the sail 15 passes through the slot 16.

With profile masts 1, there exists a danger that in a strong wind, the vessel may be endangered by convergence of the flow. For this phase of operation, the profile mast 1 has a receptacle in the upper mast area for the fastening of a large volume cable 20. This cable 20 is used for the spiral winding of the profile mast to achieve an airflow separation. That is, the cable 20 can be wound around the profile mast 1 to prevent unfurling of the sail 15. Alternatively, the cable 20 can wind the sail 15 around the mast 1.

One feature of the invention resides broadly in a profile mast for sailing vessels which is mounted and braced so that it can rotate, with the foot of the mast between the deck and the keel area of the vessel, and in the rear mast area, there is a receptacle for the reefing shaft of a roller reefing device on which the sail guided through a slot on the rear edge of the profile mast can be rolled up, characterized by the fact that the wall parts 17 of the rear area of the profile mast 1 designed as a receptacle 14 for the reefing roller 15, 21 have elastic areas 18, and that on the rear edge of the profile mast 1 there are end strips 19, which limit the slot 16 for the emergence of the sail 15, such that the end strips 19 are elastically mounted and can be pressed against one another as a result of the elastic areas 18 of the partition parts 17.

Another feature of the invention resides broadly in a profile mast, characterized by the fact that the end strips 19 on the side facing the sail 15 are designed with a raised profile.

Yet another feature of the invention resides broadly in a profile mast, characterized by the fact that the end strips have beads 19', which continue into the vicinity of the reef shaft 21 and which limit a passage for the sail 15.

A yet further feature of the invention resides broadly in a profile mast, characterized by the fact that in the forward area 13 of the profile mast 1 there are arresting stays 9 to rotate the profile mast 1 engaged with the profile lug running along both sides of the vessel 5.

A yet another feature of the invention resides broadly in a profile mast, characterized by the fact that the arresting stays 9 on both sides can be adjustably coupled by means of a drive apparatus 10 for the rotational movement.

Another further feature of the invention resides broadly in a profile mast, characterized by the fact that the profile mast 1 is formed by stiffened shells 25 made of carbon fiber reinforced plastic (CFK), which are rigidly connected by spars 11, 12 in the forward area 13, and that the elastic areas 18 of the wall parts 17 are formed in the rear area of the profile mast 1 by reducing the wall pieces.

A further feature of the invention resides broadly in a profile mast, characterized by the fact that the profile mast 1 is formed by stiffened shells 25 of carbon fiber reinforced plastic (CFK), which are rigidly connected by a web 24 in the forward area 13, and that the elastic areas 18 of the wall parts 17 in the rear area of the profile mast 1 are formed by reducing the wall parts.

A further feature of the invention resides broadly in a profile mast, characterized by the fact that the profile mast 1 has a receptacle for a large-volume cable 20 fastened in the upper mast area, for the spiral winding to achieve flow separation.

A sail furling and reefing apparatus is disclosed in U.S. Pat. No. 4,267,790. In addition, a sailboat is disclosed in U.S. Pat. No. 4,487,148.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The appended drawings in their entirety, including all dimensions, proportions and/or shapes in at least one embodiment of the invention, are accurate and to scale and are hereby incorporated by reference into this specification.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A sailing vessel comprising:

a hull with a keel and a deck;

a profile mast rotatably mounted on said hull;

said profile mast comprising a mast body having aerodynamic sides, said aerodynamic sides forming an aerodynamic forward portion and said aerodynamic sides extending rearward from said forward portion, said aerodynamic sides having end strips at the rear edges, and said aerodynamic sides converging towards each other rearward to form a slot at the rear of said profile mast;

means for retracting and paying out a sail through said slot;

means within said mast body for receiving said means for retracting and paying out a sail through said slot;

a sail disposed on said means for retracting and paying out a sail through said slot;

a boom disposed on said profile mast for supporting said sail;

said aerodynamic sides of said mast body having elastic wall parts being configured to press said end strips towards on another for providing an aerodynamically favorable transition area between said profile mast and said sail;

wherein said end strips are designed with a raised profile on the sides of said end strips facing one another;

wherein said end strips have beads which continue into the vicinity of said means for retracting and paying out a sail through said slot, said beads being configured to form a passage for said sail; and wherein each of said aerodynamic sides is formed by a stiffened shell made of carbon fiber reinforced plastic (CFK), said stiffened shells are rigidly connected by at least one of spars and a web, and said elastic walls parts are formed by reducing the thickness of the rear portions of said stiffened shells.

2. The sailing vessel according to claim 1, wherein there are arresting stays attached to said profile mast, to rotate said profile mast.

3. The sailing vessel according to claim 2, wherein said arresting stays are directed to both sides of said vessel and are adjustably coupled by means of a drive apparatus for the rotational movement of said profile mast.

4. The sailing vessel according to claim 3, wherein said profile mast, in the upper mast area, has a receptacle for a large-volume cable which large volume cable is for spiral winding to achieve flow separation.

5. The sailing vessel according to claim 4, wherein:

said arresting stays are attached to the forward area of said profile mast approximately below one-half the mast height;

said drive apparatus for the rotational movement of said profile mast comprises a cylinder arrangement;

said means within said mast body for receiving said means for retracting and paying out a sail through said slot comprise a receptacle chamber in the rear area of said profile mast; and said means for retracting and paying out a sail through said slot comprise a roller for rolling said sail.

6. A profile mast for being rotatably mounted on a sailing vessel, the profile mast comprising:

a mast body having aerodynamic sides, said aerodynamic sides forming an aerodynamic forward portion and said aerodynamic sides extending rearward from said forward portion, said aerodynamic sides having end strips at the rear edges, and said aerodynamic sides converging towards each other rearward to form a slot at the rear of the profile mast;

means for accepting means for rotating said mast body;

means for retracting and paying out a sail through said slot;

means within said mast body for receiving said means for retracting and paying out a sail through said slot;

said aerodynamic sides of said mast body having elastic wall parts being configured to press said end strips towards one another for providing an aerodynamically favorable transition area between the profile mast and a sail;

wherein said end strips are designed with a raised profile on the sides of said end strips facing one another;

wherein said end strips have beads which continue into the vicinity of said means for retracting and paying out a sail through said slot, said beads being configured to form a passage for a sail; and wherein each of said aerodynamic sides is formed by a stiffened shell made of carbon fiber reinforced plastic (CFK), said stiffened shells are rigidly connected by at least one spars and a web, and said elastic wall parts are formed by reducing the thickness of the rear portions of said stiffened shells.

7. The profile mast according to claim 6, wherein there are arresting stays attached to the profile mast, to rotate the profile mast.

8. The profile mast according to claim 7, wherein said arresting stays are for being directed to both sides of a vessel and can be adjustably coupled by means of a drive apparatus for the rotational movement.

9. The profile mast according to claim 8, wherein the profile mast, in the upper mast area, has a receptacle for a large-volume cable which large volume cable is for spiral winding to achieve flow separation.

10. The profile mast according to claim 9, wherein said means within said mast body for receiving said means for retracting and paying out a sail through said slot comprise a receptacle chamber in the rear area of the profile mast. .

11. The profile mast according to claim 10, wherein said means for retracting and paying out a sail through said slot comprise a roller for rolling a sail.

* * * * *